US009719301B2

(12) United States Patent
Molaschi et al.

(10) Patent No.: US 9,719,301 B2
(45) Date of Patent: Aug. 1, 2017

(54) PROCESS FOR CONSTRUCTING A WELL FOR EXPLOITING A RESERVOIR UNDER A SEA-BED OR OCEAN-BED

(71) Applicant: ENI S.P.A., Rome (IT)

(72) Inventors: Claudio Molaschi, Crema (IT); Alberto Maliardi, San Donato Milanese (IT); Paolo Ferrara, Milan (IT)

(73) Assignee: ENI S.p.A., Rome (IT)

( * ) Notice: Subject to any disclaimer, the term of this patent is extended or adjusted under 35 U.S.C. 154(b) by 0 days.

(21) Appl. No.: 15/029,926

(22) PCT Filed: Oct. 16, 2014

(86) PCT No.: PCT/IB2014/065379

§ 371 (c)(1),
(2) Date: Apr. 15, 2016

(87) PCT Pub. No.: WO2015/056218

PCT Pub. Date: Apr. 23, 2015

(65) Prior Publication Data

US 2016/0298393 A1 Oct. 13, 2016

(30) Foreign Application Priority Data

Oct. 17, 2013 (IT) ..... MI2013A1733

(51) Int. Cl.
*E21B 7/12* (2006.01)
*E21B 17/01* (2006.01)
(Continued)

(52) U.S. Cl.
CPC ..... *E21B 7/12* (2013.01); *E21B 10/00* (2013.01); *E21B 17/01* (2013.01); *E21B 33/038* (2013.01);
(Continued)

(58) Field of Classification Search
CPC ..... E21B 7/12; E21B 17/01; E21B 19/002; E21B 19/004; E21B 21/001; E21B 33/038; E21B 33/043; E21B 43/01
See application file for complete search history.

(56) References Cited

U.S. PATENT DOCUMENTS 6,085,851 A * 7/2000 Scott ..... B63B 35/4413 175/7
6,273,193 B1 * 8/2001 Hermann ..... E21B 7/128 166/350

(Continued)

FOREIGN PATENT DOCUMENTS

WO WO 00/34619 A1 6/2000

OTHER PUBLICATIONS

International Search Report and Written Opinion issued Apr. 21, 2015 in PCT/IB2014/065379 filed Oct. 16, 2014.

(Continued)

*Primary Examiner* — Matthew R Buck
(74) *Attorney, Agent, or Firm* — Oblon, McClelland, Maier & Neustadt, L.L.P.

(57) ABSTRACT

A process for constructing a well (1) for exploiting an oil or gas reservoir, comprising the following operations: (A) drilling a formation submerged by a water head, at least 3,600 meters deep or more, reaching the formation from the surface of the water with a drilling riser (7), and a drilling tool which passes internally through the drilling riser; and evacuating through the drilling riser (7) at least one of the circulating drilling fluid, the oil or natural gas coming from the formations and the resulting drilling materials. The drilling riser (7) has an external diameter equal to or smaller than 17 inches and reaches a wellhead (3) having an internal diameter equal to or smaller than 18.75 inches, and posi- (Continued)

tioned in correspondence with or close to the seabed submerged which covers the formation.

9 Claims, 3 Drawing Sheets

(51) Int. Cl.

| | |
|---|---|
| ***E21B 10/00*** | (2006.01) |
| ***E21B 33/038*** | (2006.01) |
| ***E21B 33/043*** | (2006.01) |
| ***E21B 43/01*** | (2006.01) |
| *E21B 10/28* | (2006.01) |
| *E21B 17/10* | (2006.01) |
| *E21B 33/064* | (2006.01) |

(52) U.S. Cl.
CPC ..... *E21B 33/043* (2013.01); *E21B 43/01* (2013.01); *E21B 10/28* (2013.01); *E21B 17/1078* (2013.01); *E21B 33/064* (2013.01)

(56) References Cited

U.S. PATENT DOCUMENTS

| | | | | |
|---|---|---|---|---|
| 6,352,114 | B1 | 3/2002 | Toalson et al. | |
| 6,802,379 | B2 * | 10/2004 | Dawson | E21B 21/08 175/206 |
| 7,367,410 | B2 * | 5/2008 | Sangesland | E21B 33/043 166/358 |
| 2004/0065474 | A1 * | 4/2004 | Turner | E21B 7/122 175/5 |
| 2011/0127040 | A1 * | 6/2011 | Humphreys | E21B 17/017 166/345 |
| 2011/0247827 | A1 * | 10/2011 | Humphreys | B63B 35/4413 166/345 |

OTHER PUBLICATIONS

Darrel K. Pelley, et al., "Mooring and Riser Management in Ultra-Deep Water and Beyond," SPE International, Society of Petroleum Engineers/ International Association of Drilling Contractors, SPE/IADC 92616, XP055122872, Feb. 2005, pp. 1-14.

* cited by examiner

PROCESS FOR CONSTRUCTING A WELL FOR EXPLOITING A RESERVOIR UNDER A SEA-BED OR OCEAN-BED

FIELD OF THE INVENTION

The present invention relates to a process for constructing wells for extracting petroleum, natural gas or other fluids, from submerged reservoirs situated for example under sea beds or ocean beds. The process according to the invention is particularly suitable for producing wells in deep and ultra-deep water.

STATE OF THE ART

One of the present tendencies in the field of the extraction of natural hydrocarbons is to find and exploit reservoirs situated under increasingly deep sea beds or ocean beds. In the years 1970-1980 the maximum depths of offshore wells in production were about 300 meters, becoming 1500 meters in the years 1990-2000 and about 3000 meters in the years 2000-2010.

As of today, the world record for the water depth in which an oil well has been produced is 3,174 m effected by the drillship Dhirubhai Deepwater KG1 on Jul. 8, 2013, and the most modern and best performing drilling vessels have a declared maximum operational range of approximately 3600 m of water depth.

The known art has evolved over the years, using drilling risers with an external diameter of 21" and well heads having an internal diameter of 18¾ inches, capable of suspending, in their interior, up to three high-pressure columns, of which the smallest, having an external diameter of up to 7", is suitable for guaranteeing the maximum production possible of hydrocarbons of the well.

This tendency, on the other hand, has led to the use of drilling vessels or so-called semi-submersible (semisubs) having increasingly large dimensions for drilling and putting wells into production; as a rough indication, extrapolating recent historical data on the relationship between operational depth and the tonnage of drilling vessels, in order to drill and put wells into production on seabeds which are over 3,600 meters below sea level, it would be necessary for such ships to have a tonnage of over 100,000 tons, comparable to that of the largest modern aircraft carriers. The construction and management of such large vessels leads to an extremely marked increase not only in the technical problems to be solved in attempting to extend the current operational limits, but also in the construction and management costs of the vessels, which are such as to jeopardize the economic convenience of exploiting wells on seabeds at such great depths.

An objective of the present invention is to provide a process for drilling and putting into production, reservoirs situated below seabeds at great depths, which allows to extend the current operational limits of drilling rigs, in terms of both maximum water depth in which it is possible to operate and also the operational water depth of existing rigs, without having to resort to reductions in the size of the production casing with respect to those practicable and in use in the known art.

A second objective of the present invention is to provide a process for drilling and putting into production reservoirs situated below seabeds at great depths, which allows, with the same depth reached, the use of smaller-sized plants with respect to the known art, i.e. significantly extending the operational limits of existing plants in terms of water depth, consequently proving as a whole to be economically more convenient than the known processes.

SUMMARY OF THE INVENTION

These objectives for extending the operational limits to over 3,600 meters of water depth and extending the operational limits of existing plants, are achieved, in a first aspect of the present invention, with a process for constructing a well for exploiting a reservoir of a natural fluid to be extracted, having the characteristics according to claim 1.

In a second aspect of the invention, these objectives are achieved with a process having the characteristics according to claim 5.

In a third aspect of the invention, these objectives are achieved with a process for constructing a well for exploiting a reservoir of a natural fluid to be extracted, having the characteristics according to claim 6.

Further characteristics of the device are object of the dependent claims.

The advantages that can be achieved with the present invention will appear more evident, to a skilled person in the field, from the following detailed description of a particular embodiment of a non-limiting nature, illustrated with reference to the following schematic figures.

LIST OF FIGURES

DETAILED DESCRIPTION

In the present description, the expressions "upstream, from upstream, downstream, from downstream" refer to the flow of fluids extracted from a reservoir; unless otherwise indicated, for example, the drilling mud and other fluids circulating in the well are intended as flowing from upstream, downstream.

Figure 1:
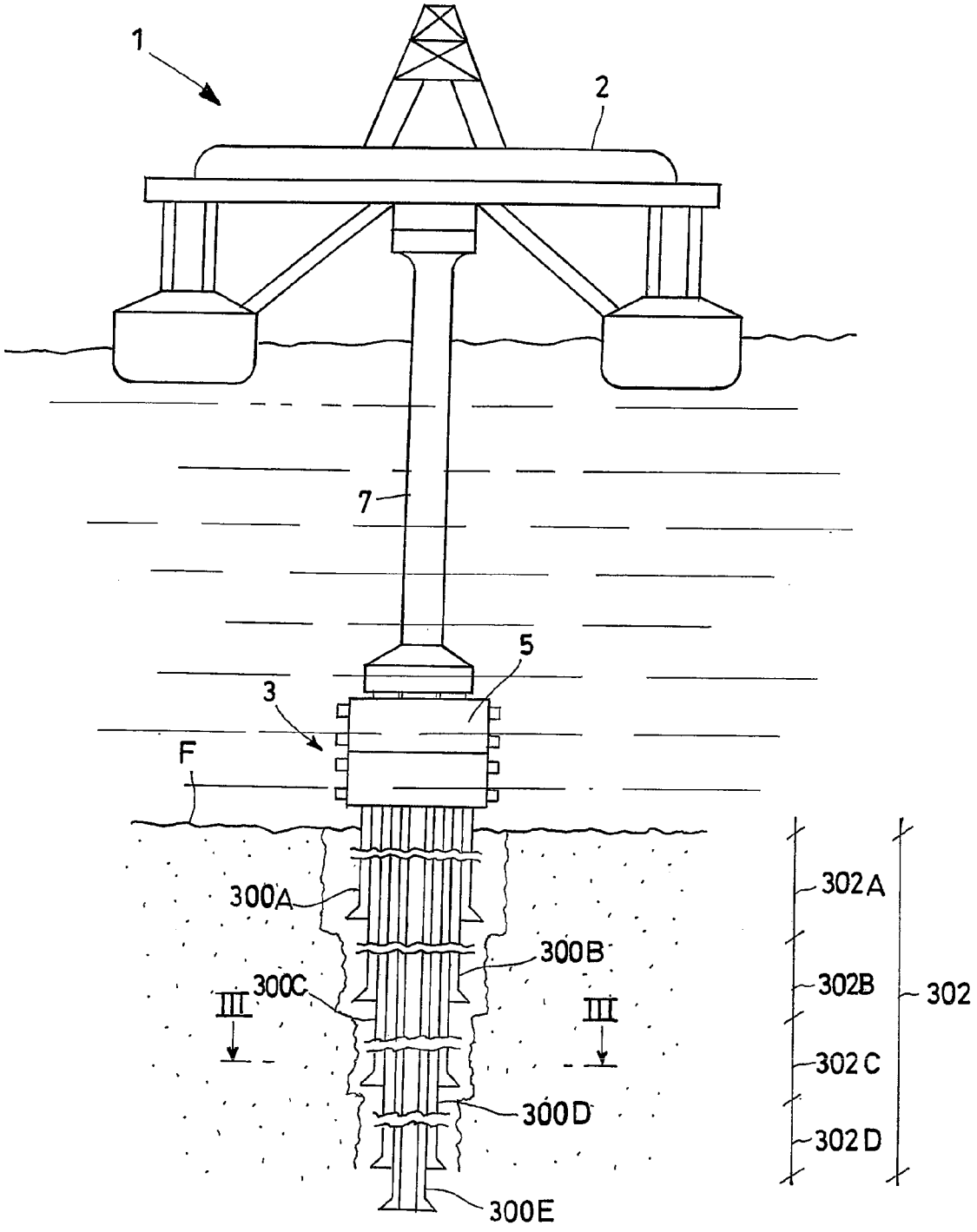
FIG. 1 shows a first section, according to a substantially vertical plane, of an extraction well according to the invention.
Figure 2:
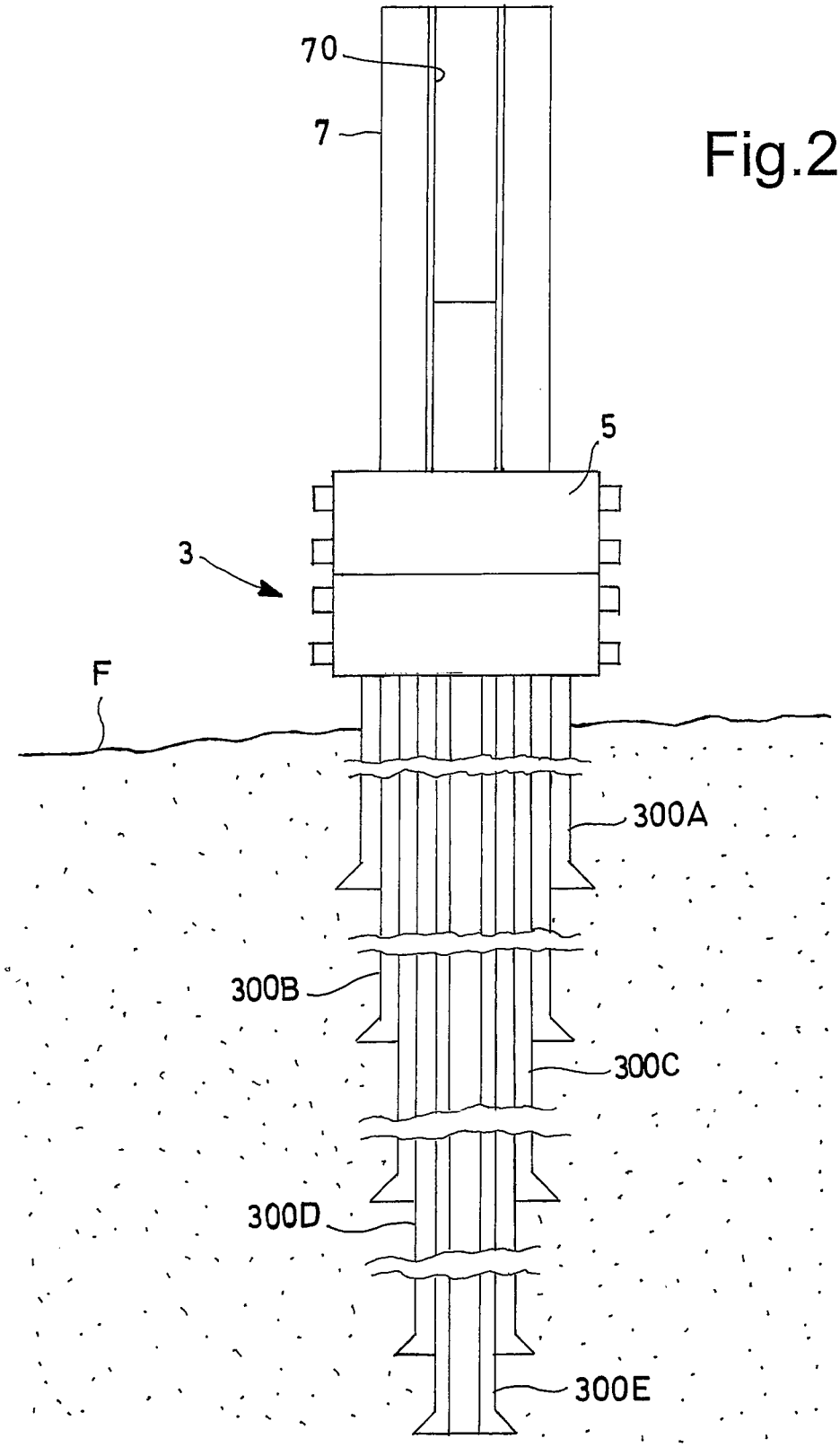
FIG. 2 shows a second section, according to a substantially vertical plane, of the well of FIG. 1.

FIGS. 1, 2 relate to a well, indicated as a whole with the reference number 1, for exploiting an underwater reservoir according to a particular embodiment of the invention.

The reservoir to be exploited, for example a reservoir of oil, natural gas or other natural fluids, is situated under a bed F submerged by a mass of water, such as for example a sea-bed or ocean-bed.

The well 1 comprises:

- a wellhead 3 situated in correspondence with or in the proximity of the submerged bed F;
- possibly, in the order from top to bottom, a conductor pipe or column 300A, and an anchorage pipe 300B, known per se;
- one or more casings 300C, 300D, 300E.

The conductor pipe 300A and anchorage pipe 300B, form, as is usual, the foundation and the first anchorage of the well to be set up. The second pipe 300B is inserted into the first pipe 300A. After 300A and 300B have been set up, the wellhead is installed, i.e. a high-pressure housing for the suspension of the three consecutive columns used for the hydraulic insulation of the formations drilled. The first casing that is suspended is 300C. The casing 300D and then 300E are subsequently suspended gradually, one inside the other. The column 300E can be the so-called production column, commonly called production casing, and preferably has an external diameter not smaller than 7" and can be suspended as the third casing inside the high-pressure housing of the wellhead.

The well 1 can also comprise further casings (not shown) again contained inside each other, with the most external of these inserted in the lower casing 300E.

The conductor pipe 300A, the guiding pipe 300B and the high-pressure casings 300C, 300D, 300E and other possible casings are inserted in a hole 302 situated in the submerged bed F and extending, for example, from the top downwards.

The wellhead unit 3 preferably comprises the part suitable for suspending the three high-pressure casings 300C, 300D and 300E and one or more blow-out preventers (BOP) 5, arranged in series on top of each other or in any case downstream of each other and fluidly downstream of the casings 300A-300E so as to form a stack.

The wellhead 3 is then fluidly and mechanically connected to a riser 7, in turn comprising a main pipe designed for transferring the circulating drilling fluid that is the so-called drilling mud—or the natural fluid coming from the formations, and also the debris material coming from the drilling, from the wellhead 3 towards the sea or ocean surface. The riser can comprise a plurality of modular portions or sections, each of which comprising, for example:

- one or more main pipes 70, each of which is designed for allowing the passage of the bit and drill rods and mud rising from the excavation itself;
- a possible supporting structure for sustaining and reinforcing the one or more main pipes;
- suitable floats for at least partially supporting the riser 7.

The term bit in the present description refers to a drilling head or tool having one or more tips or cutters, for example rotating.

Each modular section of the riser 7 can also comprise electric, oil-dynamic, pneumatic lines, as well as high-pressure lines for the passage of the circulating fluids used for the drilling (drilling mud) or fluids coming from drilled formations, such as, for example, oil or natural gas.

The various casings 300A-300E are preferably made of steel.

The columns 300A and B can, for example, have a diameter of 30" and 14" respectively.

According to an aspect of the invention, the drilling riser 7 or at least its main pipe 70, has an external diameter preferably equal to or less than approximately 17", typically 16", whereas the wellhead 3 has an internal diameter of 18" ¾.

The wellhead 3 preferably has an internal diameter equal to or less than 14", typically 13" ⅝. The three further high-pressure casings 300C, D and E, with gradually decreasing diameters, can then be suspended in the wellhead.

The following Table can be used in a typical application:

300 C diameter 11" ¾
300 D diameter 9" ⅝
300 E diameter greater than or equal to 7".

Figure 3:
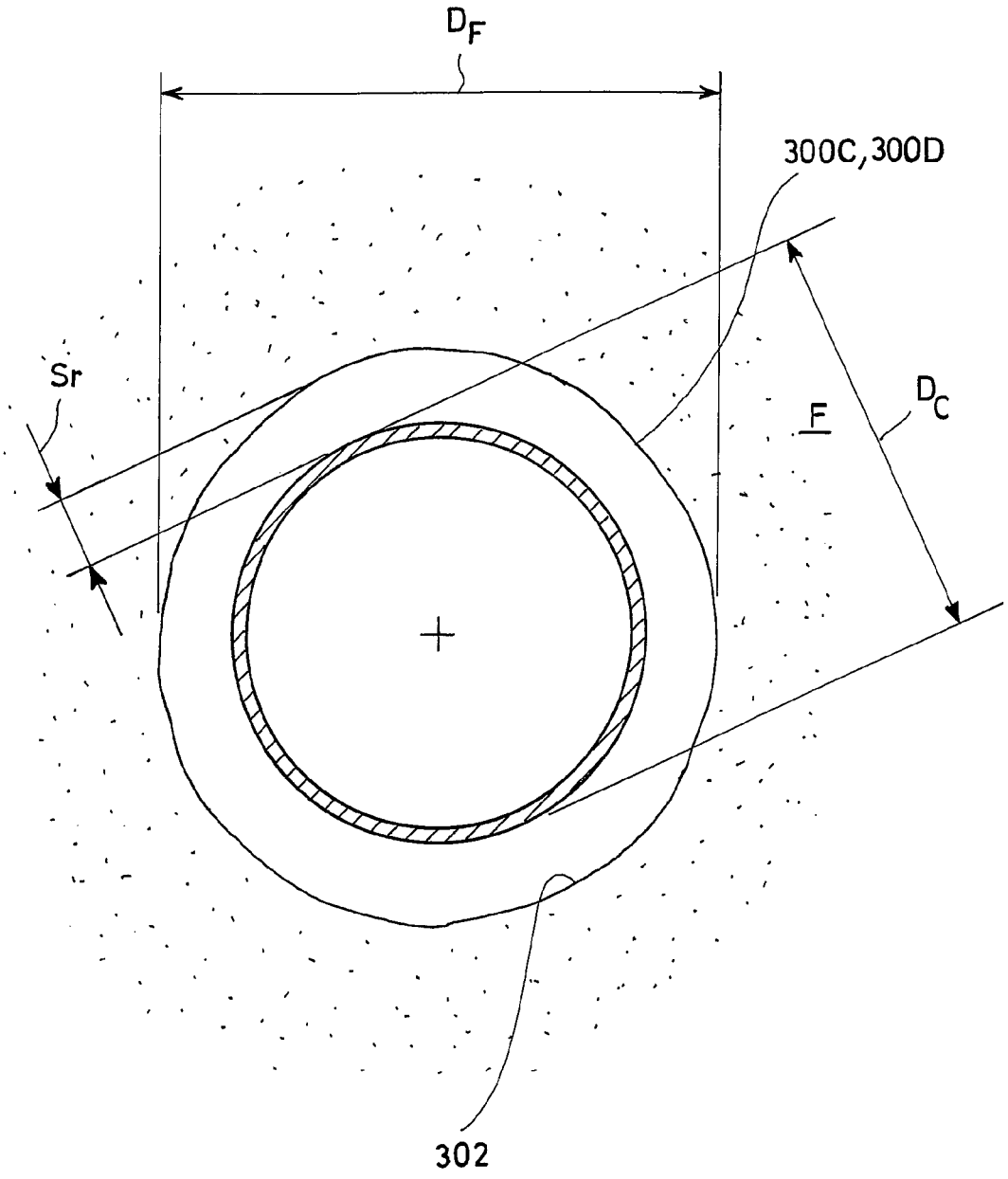
FIG. 3 shows a transversal section of the well of FIG. 1, according to the section plane III-III.

According to another aspect of the invention, the average radial clearance (FIG. 3) (Sr) between at least one column of the casings 300C, 300D and 300E, and the casings 300B, 300C and 300D, respectively, is much lower than the clearances of the known art and such that the setting-up of three high-pressure casings, comprising the casing 300E having a diameter not less than 7", requires a series of technical expedients described more specifically in the following paragraphs.

According to another aspect of the invention, the average radial clearance Sr between the at least one casing 300C, 300D and the walls of the lining hole before cementation, is substantially equal to or less than 0.08 times the external diameter of the at least one casing 300C, 300D.

Again, according to an aspect of the invention, the pipe 9 of the riser has an external diameter of its main pipe 70 equal to or smaller than about 17 inches and/or an inner diameter of its main pipe 70 equal to or smaller than 15 inches.

The external diameter of the main pipe 70 is preferably equal to or smaller than 16 inches or, again preferably, the inner diameter of the main pipe 70 is equal to or smaller than 14.75 inches (14¾). The riser can have smaller diameters also thanks to the smaller dimensions of the bit.

Said average radial clearance Sr is preferably equal to or less than 0.065 times the external diameter of the at least one casing 300C, 300D.

Said average radial clearance Sr is preferably equal to or less than 0.08 times the external diameter of some—or even more preferably—of all of the casings 300C, 300D.

Said average radial clearance Sr is preferably equal to or less than 0.065 times the external diameter of some—or even more preferably—of all of the casings 300C, 300D.

The average radial clearance Sr can be calculated as the average of the various local thicknesses Sr', each of which is measured with reference to an areola of the reference column and adjacent portion of the wall of the hole 302 which is facing said areola.

Alternatively, the average radial clearance Sr can be calculated as the difference between a) the nominal diameter of the hole excavated by the bit and b) the external nominal diameter of the casing 300C, 300D. If, as in the embodiment of the figures, the hole 302 comprises a plurality of sections 302A-302D each having a nominal diameter different from the others. The average radial clearance Sr or local thickness Sr' refers to the average or nominal diameter of each section 302A-302D of the hole and relative casing 300C, 300D which is facing the wall of that section 302C, 302D of hole.

The maximum diameters of the holes—or sections thereof—are advantageously correlated to the maximum external diameters of the relative casings as indicated in the following table.

| Maximum external diameter of one of the casings (inches) | Maximum average or nominal diameter of the section of hole facing the casing (inches) | Maximum average radial clearance (inches) |
|---|---|---|
| 16 | 17.5 | 0.75 |
| 13.375 | 14.75 | 0.69 |
| 11.75 | 12.875 | 0.56 |
| 9.675 | 10.675 | 0.5 |

Each of the one or more blow-out preventers 5 advantageously has a diameter equal to or smaller than inches, and preferably equal to or smaller than 14.75 inches.

The various casings 300A-300E and other possible casings are in fact advantageously produced and set up on the seabed with the expedients described in patent applications MI2000A000007 and WO 01/53655A1, filed in the name of the same Applicant.

In particular, the casings of the wellhead 5 are preferably and advantageously cemented in the seabed with an average difference, and preferably almost constant, not greater than 1.5-2 inches, i.e. about 3-5 cm, for the whole depth of the well affected by the casings, or in any case for the whole desired depth of the well.

In order to obtain the gaps described above between the casings and the walls of the hole 302, the drilling of the well advantageously comprises the following operations:

- automatic control of the verticality of the well;
- use of bits equipped with adequate distributors and roller-reamers, in order to guarantee regularity and calibration of the hole;
- use of drilling mud with chemical and rheological characteristics which are such as to minimize any possible problems of instability of the hole;
- constant control of all the drilling parameters so as to maintain a curvature (BUR/DO) of 0.7 degrees for every 30 meters, with a maximum tilt of 1.5 degrees in the vertical sections.

After creating a perfectly vertical and well calibrated hole, the lowering of the well casing is preferably performed. In order to facilitate the passage of the pipes in the calibrated hole with a reduced clearance, one or more of the following expedients, described in patent applications MI2000A000007 and WO 01/53655A1, are advantageously adopted:

- using threaded connections of the flush or near-flush type;
- checking the perfect rectilinearity of the pipes, or in any case using pipes with tolerances lower than those provided for by current API regulations;
- limiting the use of centralizers, and if necessary using Integral Blade Centralizers or ceramic centralizers;
- during the pipe laying, limiting the descent rate of the column to avoid forcing and the creation of dangerous ramming linked to the reduced ring dimensions;
- using cementating shoes of the centralized type;
- during cementing job, using special malts with a high fluidity and high mechanical resistance;
- planning the curvature in relation to the flexibility of the casings to be used.

The wellhead 3, and in particular its portion that protrudes or in any case emerges from the submerged seabed F, is advantageously situated at the seabottom at a depth that can reach 4,500 m.

The laying and cementation of the casings is one of the most critical phases of the construction of an underwater extraction well, and becomes increasingly more critical the greater the depth below sea level at which the wellhead 3 is to be located. This initial phase of the construction of the well is in fact critical from a technical point of view due, for example, to the great thickness of the mud forming the surface layer of the seabed; this thickness can in fact also reach several tens of meters. The considerable pressures to which the mud and seawater impregnating it, are subjected, represent a further critical aspect, which generally complicates the excavation of the well hole, making it difficult to maintain precise tolerances during its excavation and the laying and cementing of the casings. An extremely precise positioning—or cementation—such as the verticality of the well and height (stitch) of the upper end of the casing situated further up, is particularly advantageous, as it also allows the construction of the possible fluid transportation lines to be standardized and anticipated even by various months, which will enable the well to be exploited in the production phase, i.e. at regime, with considerable savings from an economic and management point of view. In order to facilitate the above well-start operations and obtain narrower construction tolerances, at great depths, the technologies developed by the Applicant with the conventional name "Deep Water Dual Casing", E-DWDC), and described for example in Italian patent application MI2000A002641 and in the corresponding U.S. Pat. No. 7,055,623, are particularly advantageous. This technology allows wellheads to be put into production on seabeds with a greater velocity, reliability and positioning precision with respect to other techniques known in the field, for example so-called "jetting".

The "deep water dual casing" technique, in fact, allows the 15-20% of failures of the jetting technique itself, for example, to be eliminated or in any case considerably reduced. The walls of the holes produced with the above-mentioned E-DWDC technique also have a much lower average roughness and fewer geometrical errors, with respect to the holes produced with the known technologies and are therefore less subject to erosion once the casings 300A-300E have been cemented to the seabed, also at the great depths in question.

The drilling operations can also be improved and facilitated with the help of the so-called E-CD (ENI Circulating Device) technologies, described in patent applications MI2005A1108, MI2007A000228, WO2008/095650 and in patent U.S. Pat. No. 7,845,433. The E-CD technologies allow a reduction in the pressure drops in the annular elements, favouring the construction of the well in deep water.

Thanks to the previous disclosures, wellheads can be produced on sea-beds or ocean-beds at great depths, equal to or greater than −3000 meters (or in any case in so-called deep and ultra-deep waters), with so-called "lean" casings 300A-302D, i.e. having the more reduced gaps previously described, with respect to wells of the known type, between the casings and walls of the hole 302 produced in the seabed or other geological formation, using drillships or other supporting vessels, platforms or semi-submarines 2 which are much lighter than those necessary with the known technologies.

In particular, the previous disclosures allow the operational drilling limits to be extended to over 3,600 m of water depth and also to the operational ranges of existing rigs, without any loss in diameter for the production casing 300E—which can have an external diameter of 7", as also in the known art—creating for example three casing suspensions in the high-pressure housing of the wellhead 3, as in the known art, which however uses drilling risers with an external diameter of 21" and wellheads with an internal diameter of 18" ¾.

The following advantages are consequently obtained, with the same diameters of the drilling holes and flow-rates of the fluids extracted from the well:

- less tonnage required of the drillship or other supporting vessel, platform or semi-submarines, for the drilling and exploitation of the well, as the wellhead 3 can be connected to the sea surface with a riser 7 having a smaller diameter and therefore much lighter, so that the vessel must carry a smaller mass of riser in loco;
- as the risers have smaller diameters, they can be more easily dimensioned or in any case adapted for reaching depths even greater than 4,000-4,500 meters, and resist the extremely high pressures involved;
- the possibility of assembling a BOP, or a stack of BOPs, on the wellhead, having a smaller nominal diameter with respect to those used in standard practice, and therefore lighter to transport with the drillship or other supporting vessel, with respect to the BOPs assembled on currently known underwater wells;
- higher drilling rate, and therefore shorter immobilization of the drillship or other supporting vessel or platform;

greater anchoring solidity of the casings to the seabottom, or in any case to the geological formation in which it is inserted;

greater safety and reliability of the wellhead.

The reduction in the external or internal diameter of the riser 7 also allows the flow-rate and overall quantity of drilling mud to be considerably reduced during the drilling of the well; as it is forbidden in many countries to spill the mud into the sea, after use, it must be recovered on the drillship or other supporting vessel or platform and taken back to land or in any case up to specific disposal plants or sites; it can therefore be easily understood that also reducing the flow-rate of the drilling mud significantly contributes to reducing the tonnage of the drillship or other supporting vessels or platforms necessary for the drilling. As the specific weight of the resulting mud to be evacuated often reaches 2 Kg/liter, i.e. approximately the double with respect to the water and mud injected into the hole 302 for lubricating the bit and evacuating the debris, it can also be understood that a reduction in the diameter—or diameters—of the hole 302 leads to a considerable reduction in the weight of the resulting mud.

In order to make it even lighter, the riser 7 can be produced, or in any case have a load bearing structure, made of materials different from steel, such as for example, a suitable alloy based on aluminium or titanium or composite materials based on synthetic resins. This choice of materials also helps to maximize the operational limits or minimize the dimensions of the plants.

The embodiment examples previously described can undergo several modifications and variations which, however, are included in the protection scope of the present invention. Furthermore, all the details can be substituted by technically equivalent elements. The materials used, for example, as also the dimensions, can vary according to technical requirements. It should be understood that an expression of the type "A comprises B, C, D" or "A is composed of B, C, D" also comprises and describes the particular case in which "A consists of B, C, D". The examples and lists of possible variants of the present patent application should be considered as being non-exhaustive lists.

The invention claimed is:

1. A process for constructing a well for exploiting a reservoir of a natural fluid to be extracted, the process comprising:

drilling a hole, called lining hole, in a formation submerged by a water head, at least 3,600 meters deep, reaching the formation from the surface of the water by:

a drilling riser, wherein the drilling riser comprises one or more main pipes, each of which are adapted for conveying at least one of the natural fluid extracted from the reservoir and a drill mud to the reservoir, wherein the one or more main pipes of the drilling riser are made of an aluminum alloy or composite material comprising a synthetic resin, and a drilling tool which passes internally through the drilling riser;

installing, in the formation to be exploited, a production casing; and evacuating through the drilling riser at least one of the drill mud, the natural fluid coming from the formations, or resulting materials of the drilling;

wherein the production casing has an external diameter greater than or equal to 7 inches, and the drilling riser has an external diameter equal to or smaller than 17 inches and reaches a wellhead having an inner diameter equal to or smaller than 18.75 inches, the wellhead being positioned in correspondence with or close to the submerged bottom which covers the formation.

2. The process according to claim 1, wherein the wellhead has an inner diameter equal to or smaller than 14 inches.

3. The process according to claim 1, wherein the reservoir is situated under a seabed, ocean-bed or other bed submerged by a mass of water, wherein the process comprises:

providing the wellhead at or near a submerged seabed;

drilling the hole, called the lining hole, in the seabed;

inserting into the lining hole, at least one casing, and fixing said casing to the wellhead, so that the average radial clearance (Sr) between the at least one casing and the walls of the lining hole, before cementation, is substantially equal to or less than 0.08 times the outer diameter of the at least one casing; and connecting the wellhead to the drilling riser comprising the one or more pipes adapted for transferring the natural fluid extracted from the wellhead towards the surface of the water and having an inner diameter equal to or smaller than 15 inches.

4. The process according to claim 3, comprising the operation of inserting and cementing a plurality of casings in the lining hole, and fixing them to the wellhead so that the average radial clearance between at least some of the casings and the walls of the lining hole, before cementation, is substantially equal to or less than 0.08 times the outer diameter of the at least one casing.

5. The process according to claim 3, comprising the operation of positioning the wellhead in correspondence with or close to a seabed submerged by at least 3,600 meters of water head.

6. The process according to claim 3, comprising the operation of positioning the wellhead in correspondence with or close to a seabed submerged by at least 4,500 meters of water head.

7. The process according to claim 3, wherein the average radial clearance (Sr) between the at least one casing and the walls of the lining hole, before cementation, is substantially equal to or less than 0.065 times the outer diameter of the at least one casing.

8. The process according to claim 3, comprising the following operations:

while the lining hole is being excavated with a drill bit, injecting a flow of drill mud into the lining hole to lubricate the drill bit and evacuate debris and other resulting material from its proximity;

transporting the drill mud and resulting material substantially up to the surface of the sea, ocean or other water mass under which the bed is submerged.

9. The process according to claim 3, wherein an initial drilling phase of oil wells in deep or ultra-deep water, with the wellhead, comprises an operation of effecting a laying and cementation of a guiding pipe and anchoring casing through a single drilling phase, wherein the drilling is effected by means of a drilling string comprising a drill bit and a hole opener, in addition to a motor suitable for activating the drill bit, independently of the hole opener.

* * * * *